United States Patent [19]

Ancier

[11] Patent Number: 4,777,690

[45] Date of Patent: Oct. 18, 1988

[54] MOP

[76] Inventor: Charlotte T. Ancier, 309 Jutland Dr., Cranbury, N.J. 08512

[21] Appl. No.: 54,727

[22] Filed: May 27, 1987

[51] Int. Cl.[4] ..... A47L 13/14

[52] U.S. Cl. ..... 15/119 A; 15/244.1

[58] Field of Search ..... 15/119 R, 119 A, 116 R, 15/116 A, 244 R, 244 A, 244 C, 228, 209 C, 209 D; 51/400; 428/228, 273

[56] References Cited

U.S. PATENT DOCUMENTS 3,008,163 11/1961 Bommer ..... 15/119 A 4,104,435 8/1978 Ballesteros ..... 15/209 C 4,196,488 4/1980 Barry ..... 15/119 A 4,333,198 6/1982 Vosbikian ..... 15/119 A

FOREIGN PATENT DOCUMENTS 587229 1/1959 Italy ..... 15/119 A

*Primary Examiner*—Edward L. Roberts

*Attorney, Agent, or Firm*—Leon Gilden

[57] ABSTRACT

An improved mop for cleaning floors includes the use of a glass-fiber pad mounted to the end of a conventional handle. A wringing mechanism permits liquid to be squeezed out of the mop pad when desired.

1 Claim, 2 Drawing Sheets

MOP

BACKGROUND OF THE INVENTION

1. Field of the Invention

The present invention relates to cleaning devices, and more particularly pertains to a new and improved mop for cleaning floors.

2. Description of the Prior Art

There are literally hundreds of different designs of mops now commercially available, and many of these mops include patented features. The great majority of these prior art mops are clearly functional for their intended purposes and can be utilized interchangeably to clean various types of structures. Since it is the desire of each manufacturer to provide a mop which can be utilized to clean any type of surface, little or no consideration is normally given to the structural modification of the mop pad or the material from which it is manufactured wherein such modification would limit the types of surfaces on which the pad could be used. Typically, such mops include the use of heads formed from sponge material or alternatively, they are quite frequently formed from strands of liquid absorbent material, such as cotton or the like.

As is well known in the prior art, the use of a long handled cloth or foam rubber mop is usually not sufficient for removing various types of stains and spots from some types of specific floor materials, e.g., no-wax floor coverings. Frequently, an individual must employ the use of some type of scouring pad to achieve the necessary abrasive cleaning action required for these special types of floor materials. Unfortunately, scouring pads can be quite damaging to no-wax floor materials inasmuch as excessive scratching and scarring may occur. This type of abrasive action may actually destroy the original shine of the no-wax floor material. Accordingly, there appears to be a continuing need for new and improved mop constructions which are specifically designed for the cleaning of specialized floor materials, such as no-wax floor coverings, and in this respect, the present invention addresses this need.

SUMMARY OF THE INVENTION

In view of the foregoing disadvantages inherent in the known types of mops now present in the prior art, the present invention provides an improved mop construction wherein the same is specifically designed for the cleaning of no-wax floor coverings. As such, the general purpose of the present invention, which will be described subsequently in greater detail, is to provide a new and improved mop which has all the advantages of the prior art mops and none of the disadvantages.

To attain this, the present invention comprises the use of a long-handled mop having a floor cleaning pad formed from a glass-fiber material. More specifically, the pad is constructed from a plurality of fiberglass strands which are randomly intertwined in a manner similar to a scouring pad. The fiberglass strands are retained together in the contoured shape of a conventional mop pad, and a sliding wringer mechanism can be utilized to squeeze liquid out of the mop pad when desired.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mop which has all the advantages of the prior art mops and none of the disadvantages.

It is another object of the present invention to provide a new and improved mop which may be easily and efficiently manufactured and marketed.

It is a further object of the present invention to provide a new and improved mop which is of a durable and reliable construction.

An even further object of the present invention is to provide a new and improved mop which is susceptible of a low cost of manufacture with regard to both materials and labor, and which accordingly is then susceptible of low prices of sale to the consuming public, thereby making such mops economically available to the buying public.

Still yet another object of the present invention is to provide a new and improved mop which provides in the apparatuses and methods of the prior art some of the advantages thereof, while simultaneously overcoming some of the disadvantages normally associated therewith.

Still another object of the present invention is to provide a new and improved mop which facilitates the cleaning of no-wax floor coverings.

Yet another object of the present invention is to provide a new and improved mop which will not scratch floor coverings provided with a permanent sheen.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
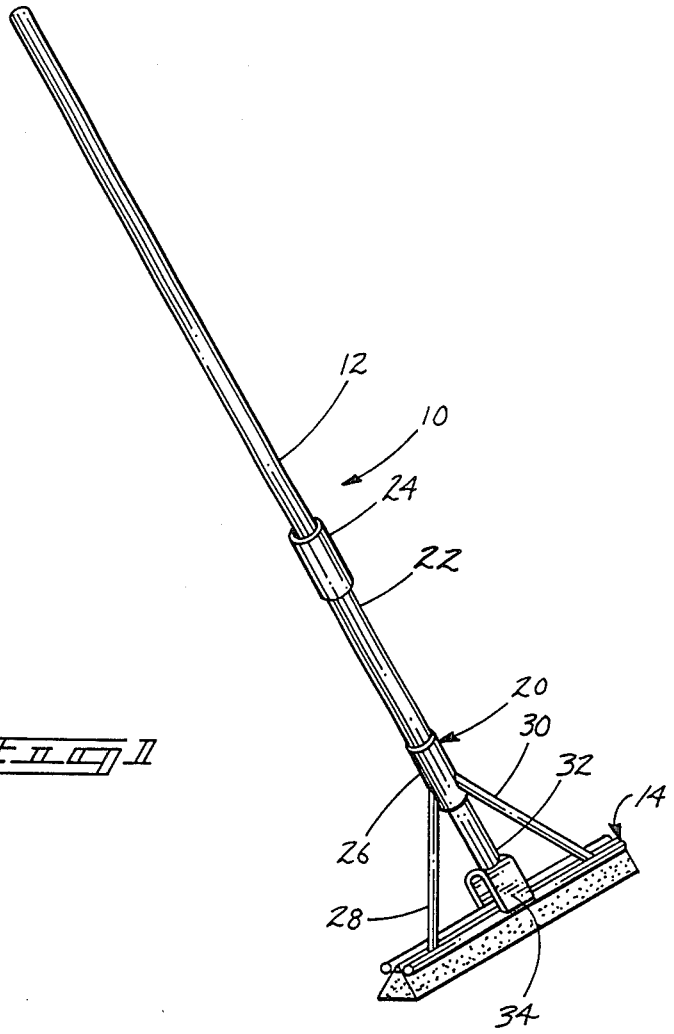
FIG. 1 is a perspective view of the improved mop comprising the present invention.
Figure 2:
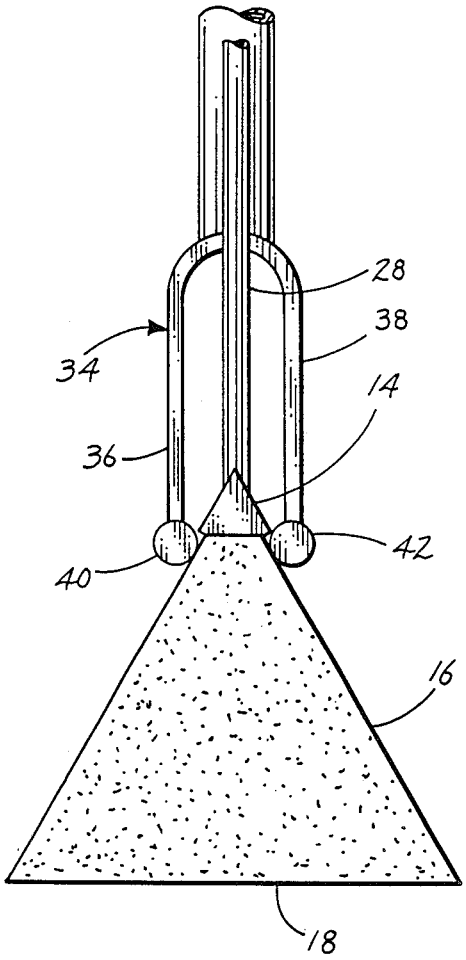
FIG. 2 is a partial side elevation view thereof.

With reference now to the drawings, and in particular to FIGS. 1 and 2 thereof, a new and improved mop embodying the principles and concepts of the present invention and generally designated by the reference numeral 10 will be described.

More specifically, it will be noted that the mop 10 essentially incudes a long handle 12 of a conventional design with a mop pad retaining head 14 being fixedly secured to conduit 20. The head 14 can be of any conceivable shape and design and can include any conventional means for retaining a surface cleaning pad 16. Accordingly, all known types and conceivable designs of pad holding devices associated with the mop are within the intent and purview of the present invention.

With further reference to the drawings, it will be observed that the mop pad 16 is desirably of an elongated triangular shape which then provides for a wide floor contacting surface 18 as best illustrated in FIG. 2. In order to clean specialized floor coverings, such as the aforementioned no-wax floor material, the present invention requires that the pad 16 be constructed from a flexible glass-fiber material. This glass-fiber material is commercially available and is presently utilized in the construction of scouring pads marketed under the tradename of Dobie pads.

The glass-fiber material from which the pad 16 is formed has a substantially large liquid holding capacity. Accordingly, the pad can be immersed into a container of cleaning solution when desired. However, some means must be provided for removing the solution after the cleaning process, and this is accomplished through the use of a novel wringer mechanism 20 relatively movable with respect to the handle 12. More specifically, a conduit 22 having a handle grip 24 attached to a top portion thereof, and the handle 12 is concentrically slidably disposed within the interior portion of the conduit. A lower reinforced section 26 of the conduit 20 includes a pair of fixedly attached outwardly extending rods 28, 30, and these rods are fixedly secured to the mop holding head 14 at its apex. Accordingly, the rods 28, 30 function as reinforcement devices for providing substantial rigidity to the mop pad 14 in a manner which should now be apparent.

Inasmuch as the mop handle 12 is slidably disposed within the conduit 22, a lower end 32 of the handle has a inverted U-shaped member 34 attached thereto. The U-shaped member 34 includes first and second legs 36, 38 respectively disposed on opposed sides of the mop pad 16. Elongated rigid rod members 40, 42 define the wringer mechanism and are substantially orthogonally aligned to the legs 36, 38 and are fixedly respectively attached thereto. The rod members 40, 42 are designed to be compressed against the mop pad 16 so as to effect a squeezing action for the purpose of removing absorbed liquid therefrom.

As to the manner of usage and operation of the present invention, the same should be apparent from the above description. However, a brief summary thereof will be provided. In this connection, it can be appreciated that the mop 16 can be immersed into a container of cleaning solution so as to absorb a quantity thereof, and the long handle 12 then permits a user to stand while cleaning a no-wax floor covering. When it is desired to remove the absorbed cleaning solution from the pad 16, a user can place one hand on the hand grip 24 and with his other hand, he can force the handle 12 slidably downwardly through the conduit 22. This results in the movement of the aligned rods 40, 42 over the pad 16 so as to effectively squeeze the pad material into a compact shape. This squeezing of course results in the release of absorbed cleaning solution.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved mop for cleaning various types of floor coverings, said mop comprising:

handle means including a bifurcated member attached to a bottom portion of said handle means, said bifurcated member including first and second legs positionable on opposed sides of an elongate cleaning pad means, said cleaning pad means formed in a triangular shape, and a wide base portion of said cleaning pad means being engagable with said floor coverings to effect a cleaning thereof, said first and second legs further including first and second parallel rigid rod members defining a wringer means; each of said first and second rigid rod members formed of a constant diameter respectively attached to said first and second legs, said first and second rigid rod members being slidably movable over said cleaning pad means to effect a squeezing action thereon, such movement of said first and second rigid rod members being occasioned by a selective slidable movement of said handle means relative to a conduit wherein said handle means is concentrically positioned within said conduit associated with said wringer means, and said conduit further including first and second extending rod members, said first and second extending rod members each secured to said cleaning pad means at an apex thereof and to said conduit means on opposed sides of said first and second legs of said bifurcated member to provide stability to said cleaning pad means when slidably moved between said rigid rod members, and wherein said cleaning pad means is formed of a glass-fiber material and wherein said glass-fiber material has a substantial liquid hold capacity.

* * * * *